United States Patent [19]

Parke

[11] Patent Number: 4,463,632

[45] Date of Patent: Aug. 7, 1984

[54] TOOL HAVING LOCKING DEVICE FOR ROTATABLE HEAD

[76] Inventor: W. Rod Parke, R.F.D. 3, Dixon, Ill. 61021

[21] Appl. No.: 426,862

[22] Filed: Sep. 29, 1982

[51] Int. Cl.[3] ..... B25B 13/00

[52] U.S. Cl. ..... 81/177.9; 403/93

[58] Field of Search ..... 81/177.9, 177 ST; 403/93, 104

[56] References Cited

U.S. PATENT DOCUMENTS

| | | | |
|---|---|---|---|
| 1,205,149 | 11/1916 | Bovee | 81/177.9 |
| 2,162,359 | 6/1939 | Rhinevault | 81/177 G X |
| 3,779,107 | 12/1973 | Avery | 81/177.8 |

FOREIGN PATENT DOCUMENTS

| | | |
|---|---|---|
| 0027238 | 10/1980 | European Pat. Off. . |
| 243888 | 8/1946 | Switzerland . |

*Primary Examiner*—James G. Smith

*Attorney, Agent, or Firm*—Lee, Smith & Zickert

[57] ABSTRACT

A locking device for a tool, such as ratchet wrench, having a flexible head which may be situated in a series of positions, and which has means for temporarily holding the head of the tool at a particular angle with respect to the handle. The tool has a lock bar disposed in a transverse bore in the handle and which is slideable adjacent the temporary holding means to one of two orientations. In the first orientation, the head is locked in place. In the second orientation, the temporary holding means is freed to permit change of the angular relationship between the handle and the head.

6 Claims, 3 Drawing Figures

Fig. 1.
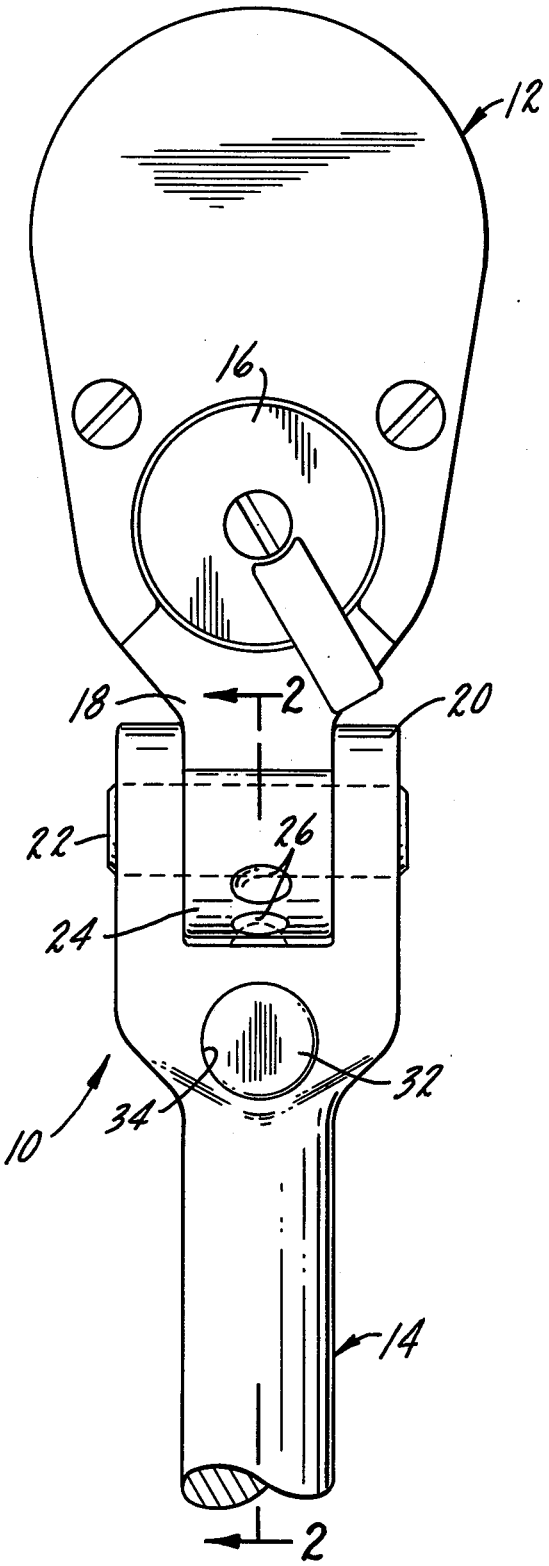
Fig. 2.
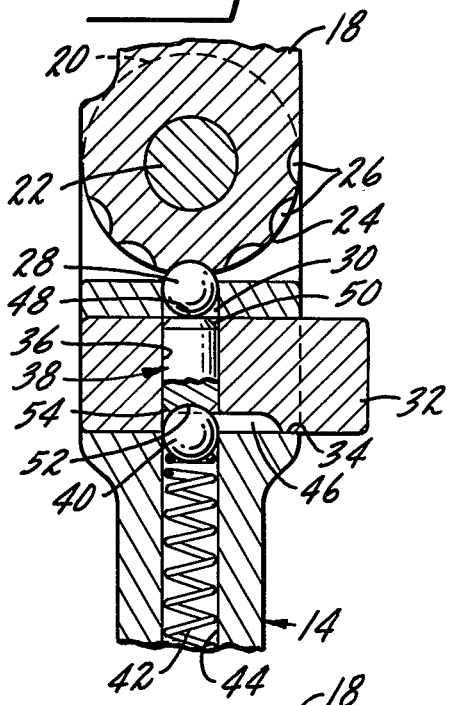
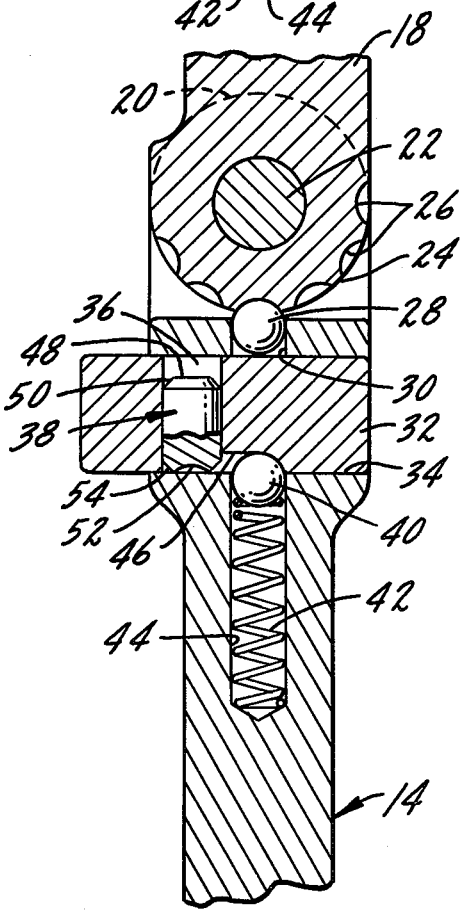
Fig. 3.

TOOL HAVING LOCKING DEVICE FOR ROTATABLE HEAD

BACKGROUND OF THE INVENTION

This invention relates to tools, and in particular to a locking device for tools having a handle portion and a head portion, the head portion being rotably attached to the handle portion such that the head portion may be positioned in a plurality of angular relationships with respect to the handle portion.

Tools having a head portion which may be aligned at various angular dispositions to the handle portion of the tool are well known. For example, in the typical ratchet wrench having a positionable head, the head of the wrench is pivotally attached to the handle by means of a pivot pin. In order to temporarily position the head at a desired location, the head includes a series of detents along an arc in the head and a spring-biased ball is situated in the handle portion, the ball being urged by the spring into one of the detents at a time. When the ball enters a detent, the head portion can be temporarily held at that location. The angle is changed by applying pressure to the face or the back of the head portion to depress the ball against the spring and allow the head to be rotated until the ball engages the next detent in the head.

A disadvantage of such a ratchet wrench is the inability to lock the head securely at a particular orientation. Sufficient pressure applied to the face or back of the head will always cause the head to rotate relative to the handle. Furthermore, as the wrench is used, in time the spring can weaken and the ball and detents become worn. The holding force of the ball/detent arrangement is therefore significantly reduced, and often the head becomes practically free and the wrench essentially useless.

Devices have been devised for locking the head of a rotatable tool, such as a ratchet wrench, in place. For example, U.S. Pat. No. 3,779,106 discloses a ratchet wrench with a series of transverse grooves in the head portion and a rotatable lock pin in the handle portion. The lock pin has one-half of its material removed so that it is semicircular in cross section adjacent the head portion in order that the head may be freely rotated when the flat portion of the lock pin is disposed toward the head portion. When the lock pin is rotated one-half revolution to engage one of the grooves, the head portion is held securely in place.

A disadvantage of this prior art device is its lack of any means to temporarily hold the head portion in place, such as by the ball/detent arrangement described above. The head of the ratchet wrench of U.S. Pat. No. 3,779,106 is either free to rotate without inhibition, or is locked in place.

Other devices have been developed for locking a rotatable tool head in place. For example, European Patent Application No. 80106063.3, filed Oct. 7, 1980, and published Apr. 22, 1981, discloses a wrench having a longitudinally slideable pin arrangement in the handle aligned to engage one of a series of sockets arcuately spaced in the head portion. Similarly, Swiss Pat. No. 243,888 discloses a locking device having a longitudinal pin urged into engagement with one of a series of sockets spaced in an arc in the head of the tool.

Both the Swiss Patent and the European Application suffer from deficiencies similar to U.S. Pat. No. 3,779,107. In both, the head is either locked into place, or is entirely free to rotate. There is no means for temporarily holding the head in combination with the locking device or while the locking device is being engaged.

SUMMARY OF THE INVENTION

The present invention is an improvement in locking devices for tools having a rotatable head, such as a ratchet wrench, and is described in relation to a ratchet wrench, although the novel concepts of the invention can be utilized in any similar tool having a rotatable head portion.

In accordance with the invention, the head portion is rotatably attached to the handle portion such that the angular relationship between the longitudinal axes of the handle portion and the head portion may be altered to an angle other than 180°, as in the conventional ratchet wrench. Also, as conventional, the invention includes means for temporarily holding the head portion at a particular angle with respect to the handle portion. The invention includes means for locking the temporary holding means to immobilize the head portion at a particular angle with respect to the handle portion, the locking means including a transverse bore in the handle portion contiguous to the temporary holding means and a lock bar slideably disposed withn the bore. The lock bar is positionable in two orientations, a first orientation to lock the temporary holding means and a second orientation to free the temporary holding means to permit change of the angular relationship between the handle portion and the head portion.

The temporary holding means includes a plurality of detents spaced along an arc in the head portion and a ball disposed in an aperture in the handle portion. The ball is positioned to selectively engage one of the detents at a time. The temporary locking means also includes a transverse opening through the lock bar and a lock pin situated in the transverse opening, the transverse opening being in registration with the ball and aperture when the lock bar is in the second orientation. The lock pin is resiliently urged against the ball when the lock bar is in the second orientation.

In accordance with the disclosed embodiment of the invention, the lock pin is urged against the ball in the second orientation by means of a second ball and a compression spring situated in a second aperture in the handle portion. The second aperture is located such that, with the lock bar in the second orientation, the second aperture, the transverse opening and the first aperture are in registration. In the first orientation, the transverse opening is offset from the first and second apertures and the first ball is securely clamped in the first aperture between the lock bar and one of the detents to prevent rotation of the head portion relative to the handle portion.

BRIEF DESCRIPTION OF THE DRAWINGS

The invention is described in greater detail in the following description of the preferred embodiment, taking in conjunction with the drawings, in which:

FIG. 1 is an elevational view of a ratchet wrench according to the invention, with the lower portion of the handle removed, FIG. 2 is a cross-sectional illustration taken along lines 2—2 of FIG. 1 showing the locking device according to the invention in the second, or free orientation, and FIG. 3 is a cross-sectional illustration similar to FIG. 2 but showing the locking device according to the invention in the first, or locked orientation.

DESCRIPTION OF THE PREFERRED EMBODIMENT

A tool according to the invention is shown generally at 10 in FIG. 1. The tool 10 includes a head portion 12 and a handle portion 14. Although the tool 10 is shown and described generally with regard to a ratchet wrench having a flexible head, it should be apparent that the novel aspects of the invention can be applied to any similar tool having a head portion rotatable relative to a handle portion.

The head portion 12 is conventional and therefore is not described in detail. The backside of the head portion 12 is shown in FIG. 1; that is, that part of the head portion 12 including the control 16 for changing the driving direction of disengageable socket heads (not illustrated) which are engaged on a sprocket extending from the face of the head portion (also not illustrated) and whose direction of rotation is dictated by the control 16.

The head portion 12 tapers to an extension 18 which is captured between a fork 20 of the handle portion 14. A transverse pivot pin 22 extends through the fork 20 and extension 18 in order to rotatably mount the head portion 12 on the handle portion 14.

The extension 18 includes an arcuate surface 24 having a plurality of spaced detents 26. A ball 28, positioned within an aperture 30 in the handle portion 14, is situated to engage one of the detents 26 at a time, when aligned with the ball 28. As in the conventional ratchet wrench, the ball 28, in combination with one of the detents 26, temporarily holds the head portion 12 at a particular angular orientation with respect to the handle portion 14.

In order to lock the head portion 12 with respect to the handle portion 14, the tool 10 includes a lock bar 32 slideably disposed within a transverse bore 34 in the handle portion. As best shown in FIGS. 2 and 3, the lock bar 32 is positionable in two orientations. In a first or locking orientation (FIG. 3), the ball 28 is clamped between the lock bar 32 and the head portion 12 within one of the detents 26, thereby precluding rotation of the head portion 12 with respect to the handle portion 14. As seen in FIG. 3, the diameter of the ball 28 closely equals the spacing between the lock bar 32 and the base of the detent 26 in which the ball 28 is engaged. As thus locked in place as shown in FIG. 3, the ball 28 securely locks the head portion 12 at a particular angular disposition with respect to the handle portion 14 as dictated by which of the detents 26 is selected.

The second orientation of the lock bar 32 is shown in FIG. 2. This is the "free" orientation in that the ball 28 is permitted to float to allow the position of the head portion 12 to be changed. As shown, the lock bar 32 includes a transverse opening 36 within which a lock pin 38 is situated. A second ball 40 and a compression spring 42 are located in an aperture 44 in alignment with the transverse opening 36 and aperture 30 such that the compression force of the spring 42 acts through the combination of the ball 40, lock pin 38 and ball 28 to resiliently urge the ball 28 into its associated detent 26. However, by applying pressure to either the face or back of the head portion 12 the head portion 12 can be rotated about the pin 22 since the ball 28 is not locked in place in the detent 26. Instead, applied pressure forces the ball 28 against the lock pin 38, which in turn forces the ball 40 to compress the spring 42. Thus, the position of the head portion 12 may be changed.

As shown in FIGS. 2 and 3, the lock pin 32 also includes a channel 46 to accommodate the ball 40 when the lock bar 32 is offset in the locked positioned (FIG. 3). The depth of the channel 46 depends on the length of the lock pin 38. The channel 46 and ball 40 guide translation of the lock bar 32 from the locked positioned (FIG. 3) to the unlocked position (FIG. 2) and also prevent the lock bar 32 from rotating within the bore 34. Also, the channel 46 and ball 40 act as a stop for the lock bar 32 in the locked position (FIG. 3) and the ball 40 and the wall of the transverse opening 36 act as a stop for the lock bar 32 in the unlocked position (FIG. 2). Therefore, the lock bar 32 cannot inadvertently be removed.

The lock pin 38 has a flat top surface 48 which bears against the ball 28 when in the second or unlocked orientation (FIG. 2). The edges of the flat top surface 48 are chamferred as shown at 50 in order to assure that the lock pin 38 does not interfere with translation of the lock pin from the second orientation to the first orientation by engaging and binding with the aperture 30. Similarly, the bottom of the lock pin 38 includes a concave portion 52 and a beveled incline 54. The concave portion 52 acts as a detent to help hold the lock pin 32 in the unlocked, second orientation (FIG. 2), while the incline 54 acts as an entry surface to facilitate entry of the ball 40 into the concave portion 52 as the lock pin 32 is translated from the first, locked orientation (FIG. 3) to the second, unlocked orientation (FIG. 2).

Various changes may be made to the invention without departing from the spirit thereof or scope of the following claims.

What is claimed is:

1. In a tool having a handle portion and a head portion, the head portion being rotatably attached to the handle portion such that the angular relationship between the longitudinal axes of the handle portion and the head portion may be altered to an angle other than 180°, and including means for temporarily holding the head portion at a particular angle with respect to the handle portion, the improvement comprising, a. means for locking said temporary holding means to immobily clamp the head portion at a particular angle with respect to the handle portion, including a transverse bore in said handle portion proximate said head portion, and a lock bar slideably disposed within said bore, said lock bar being positionable in a first orientation to lock said temporary holding means and in a second orientation to free said temporary holding means to permit change of the angular relationship between the handle portion and the head portion, b. said temporary holding means having engageable first and second holding elements, said first holding element being located in said handle portion and said second holding element being located in said lock bar, said holding elements being axially aligned and engaged when said lock bar is positioned in said second orientation and said second holding element being laterally displaced within said transverse bore when said lock bar is positioned in said first orientation such that said first and second holding elements are laterally offset from one another and not in engagement with one another.

2. A tool according to claim 1 in which said temporary holding means includes a plurality of detents spaced along an arc in the head portion and said first holding element comprises a ball disposed in an aperture in the handle portion, said ball being positioned to selectively engage one of said detents at a time.

3. A tool according to claim 2 including a transverse opening through said lock bar and in which said second holding element comprises a lock pin situated in said transverse opening, said transverse opening being in registration with said aperture when said lock bar is in the second orientation, and further including means for resiliently urging said lock pin against said ball in the second orientation.

4. A tool according to claim 3 in which said urging means comprises a second ball and a compression spring situated in a second aperture in the handle portion located such that, in the second orientation, said second aperture, said transverse opening and said first aperture are in registration.

5. A tool according to claim 2 in which said ball is clamped in said aperture between said lock bar and said one detent in the first orientation, thereby preventing rotation of the head portion relative to the handle portion.

6. A tool according to claim 3 in which said lock pin is free within said transverse opening when said lock bar is in said first orientation.

* * * * *